US008526862B2

(12) United States Patent
Sato

(10) Patent No.: US 8,526,862 B2
(45) Date of Patent: Sep. 3, 2013

(54) DEVELOPER CARTRIDGE AND DEVELOPING UNIT INCLUDING THE SAME

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 376 days.

(21) Appl. No.: 12/975,472

(22) Filed: Dec. 22, 2010

(65) Prior Publication Data

US 2011/0158684 A1 Jun. 30, 2011

(30) Foreign Application Priority Data

Dec. 25, 2009 (JP) ..... 2009-294200

(51) Int. Cl.
*G03G 15/08* (2006.01)

(52) U.S. Cl.
USPC ..... 399/260

(58) Field of Classification Search
USPC ..... 399/111, 260, 262
See application file for complete search history.

(56) References Cited

U.S. PATENT DOCUMENTS

| | | | | |
|---|---|---|---|---|
| 5,235,389 | A * | 8/1993 | Kikuchi et al. | 399/263 |
| 5,325,163 | A | 6/1994 | Nishio | |
| 6,185,401 | B1 | 2/2001 | Kanamori et al. | |
| 7,734,231 | B2 | 6/2010 | Eto et al. | |
| 7,826,779 | B2 * | 11/2010 | Mase et al. | 399/262 |
| 7,953,351 | B2 | 5/2011 | Isomura et al. | |
| 7,983,590 | B2 | 7/2011 | Sakuma | |
| 2006/0193652 | A1 | 8/2006 | Sato | |
| 2007/0065184 | A1 * | 3/2007 | Sato | 399/262 |
| 2008/0025758 | A1 | 1/2008 | Sato | |
| 2008/0175627 | A1 | 7/2008 | Sato | |
| 2008/0298837 | A1 | 12/2008 | Mase | |
| 2009/0274491 | A1 | 11/2009 | Sato | |
| 2011/0158698 | A1 | 6/2011 | Sato | |

FOREIGN PATENT DOCUMENTS

| | | | |
|---|---|---|---|
| JP | H08-240976 | A | 9/1996 |
| JP | 2005-326869 | A | 11/2005 |
| JP | 2007-086622 | A | 4/2007 |
| JP | 2008-191578 | A | 8/2008 |

(Continued)

OTHER PUBLICATIONS

Japan Patent Office, Decision to Grant a Patent for Japanese Patent Application No. 2009-294200 (counterpart to above-captioned patent application), mailed Sep. 20, 2011.

(Continued)

*Primary Examiner* — Walter L Lindsay, Jr.
*Assistant Examiner* — Frederick Wenderoth
(74) *Attorney, Agent, or Firm* — Baker Botts L.L.P.

(57) ABSTRACT

A developer cartridge includes a developer container, an agitating member, a first shutter, and a first rotatable member. The developer container includes a first arc-shaped wall having an arc shape that is concave inward in a cross-sectional view. A first opening is formed in the first arc-shaped wall. The agitating member is positioned in the developer container and configured to agitate the developer. The first shutter has an arc shape in the cross-sectional view and is configured to rotate along a periphery of the first arc-shaped wall between a first position to open the first opening and a second position to close the first opening. The first rotatable member is positioned at at least one axial end of the first shutter. The first shutter is configured to rotate in response to rotating of the first shutter.

15 Claims, 11 Drawing Sheets

(56) References Cited

FOREIGN PATENT DOCUMENTS

| | | | |
|---|---|---|---|
| JP | 2008-203830 | A | 9/2008 |
| JP | 2008-216454 | A | 9/2008 |
| JP | 2008-233862 | A | 10/2008 |
| JP | 2009-265537 | A | 11/2009 |
| JP | 2009-271099 | A | 11/2009 |

OTHER PUBLICATIONS

Japan Patent Office, Decision to Grant a Patent for Japanese Patent Application No. 2010-015307 (counterpart to above-captioned patent application), mailed Jan. 31, 2012.

* cited by examiner

DEVELOPER CARTRIDGE AND DEVELOPING UNIT INCLUDING THE SAME

CROSS REFERENCE TO RELATED APPLICATION

The present application claims priority from Japanese Patent Application No. 2009-294200, which was filed on Dec. 25, 2009, the disclosure of which is incorporated herein by reference in its entirety.

BACKGROUND

1. Field of the Invention

The present invention relates to a developer cartridge that contains developer, and a developing unit including the developer cartridge.

2. Description of the Related Art

A developer cartridge that has a partition wall having an arc shape that convex toward the developing device is known. In the developer cartridge, an opening is formed on the partition wall, and developer conveyed by an agitator is supplied to the developing device through the opening.

In the developer cartridge, since an inner face of the partition wall is concave, the agitator slides smoothly on the concave inner face and the developer may not be discharged from the opening in a good manner.

SUMMARY

A need has arisen to provide a developer cartridge, which can discharge the developer from the opening of the partition wall in a better manner, and a developing unit including the developer cartridge.

According to an embodiment of the present invention, a developer cartridge removably mounted to a developing device includes a developer container, an agitating member, a first shutter, and a first rotatable member. The developer container is configured to contain developer. The developer container includes a first arc-shaped wall having an arc shape that is concave inward in a cross-sectional view. A first opening is formed in the first arc-shaped wall. The agitating member is positioned in the developer container and configured to agitate the developer. The first shutter has an arc shape in the cross-sectional view and is configured to rotate along a periphery of the first arc-shaped wall between a first position to open the first opening and a second position to close the first opening. The first rotatable member is positioned at at least one axial end of the first shutter. The first shutter is configured to rotate in response to rotating of the first shutter.

According to another embodiment of the present invention, a developing unit includes a developer cartridge and a developing device. The developer cartridge includes a developer container, an agitating member, a first shutter, and a first rotatable member. The developer container is configured to contain developer. The developer container includes a first arc-shaped wall having an arc shape that is concave inward in a cross-sectional view. A first opening is formed in the first arc-shaped wall. The agitating member is positioned in the developer container and configured to agitate the developer. The first shutter has an arc shape in the cross-sectional view and configured to rotate along a periphery of the first arc-shaped wall between a first position to open the first opening and a second position to close the first opening. The first rotatable member is positioned at at least one axial end of the first shutter. The first shutter is configured to rotate in response to rotating of the first rotatable member. The developing device includes a second arc-shaped wall, a second shutter, and a second rotatable member. The second arc-shaped wall has an arc shape extending along the first arc-shaped wall. A second opening corresponding to the first opening is formed. The second shutter has an arc shape in the cross-sectional view and configured to rotate along a periphery of the second arc-shaped wall between a third position to open the second opening and a fourth position to close the second opening. The second rotatable member is positioned at at least one axial end of the second shutter. The second shutter is configured to rotate in response to rotating of the second rotatable member. The first rotatable member includes a first engaging portion. The second rotatable member includes a second engaging portion. The first engaging portion engages with the second engaging portion, and the first rotatable member and the second rotatable member rotate together. When the first shutter is in the first position and the second shutter is in the third position, the developer in the developer container is conveyed to the developing device through the first opening and the second opening.

DESCRIPTION OF THE PREFERRED EMBODIMENTS

An embodiment of the present invention will now be described in detail referring to the accompanying drawings. In the following description, the overall configuration of a laser printer is first briefly described, and detailed features of the present invention are subsequently described.

In the following description, directions are denoted with respect to the user who are using the laser printer. Specifically, in FIG. 1, the right side is denoted by "the front side (the near side)", the left side is denoted by "the rear side (the far side)", the far side is denoted by "the right side", the near side is denoted by "the left side", and the vertical direction is denoted by "the vertical direction". In cross-sectional views, only some particular parts are hatched for easier recognition.

[Overall Configuration of Laser Printer]

Figure 1:
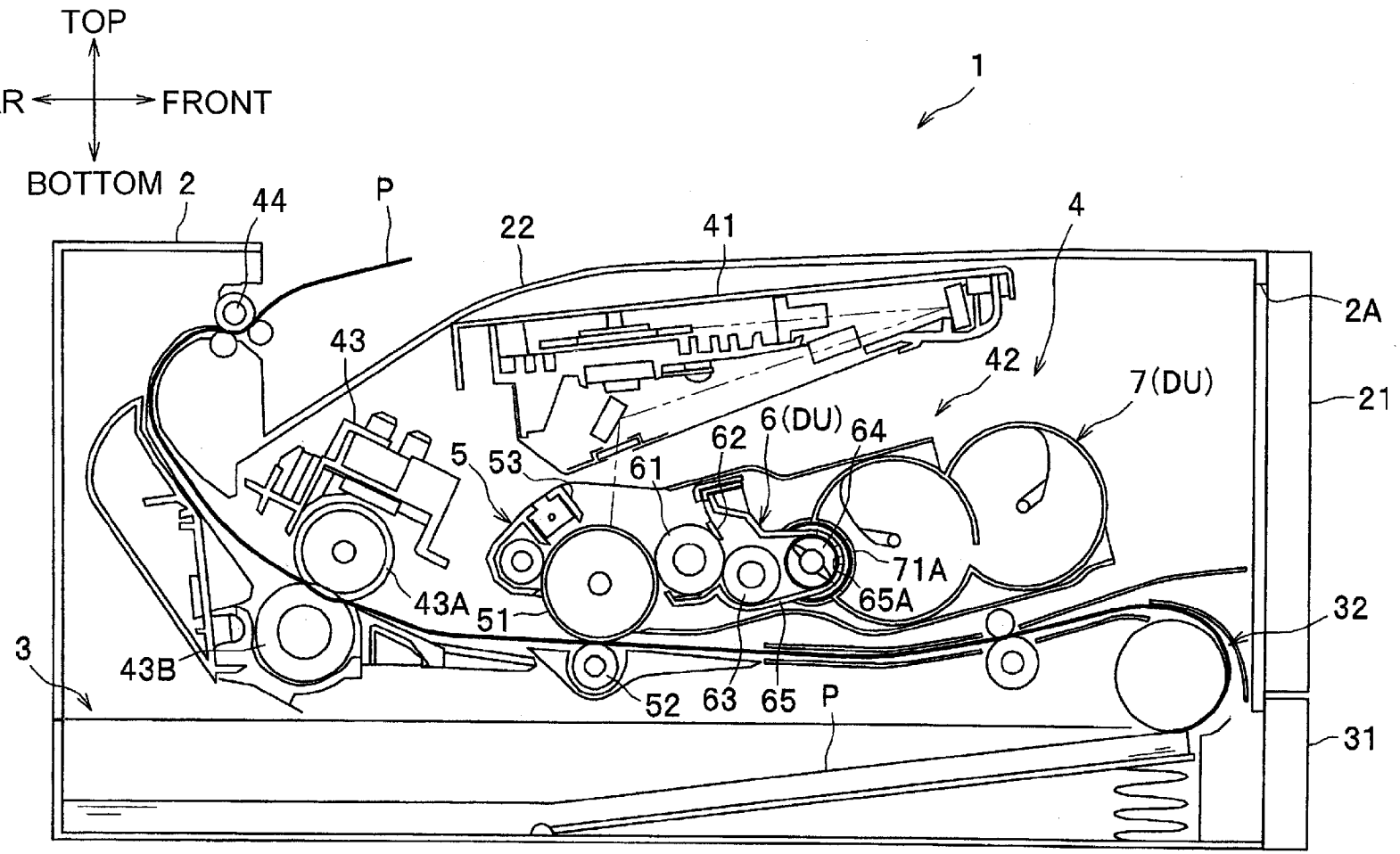
FIG. 1 is a cross-sectional view of a laser printer including a developing unit according to an embodiment of the present invention.

Referring to FIG. 1, a laser printer 1 includes an apparatus body 2, a feed section 3, an image-forming section 4, and so forth.

The apparatus body 2 is a hollow casing having an opening 2A in the front wall thereof. A front cover 21 is provided on the front wall of the apparatus body 2 in such a manner as to swing back and forth, thereby opening/closing the opening 2A. The top face of the apparatus body 2 forms a discharge tray 22 onto which printed paper P is to be placed.

The feed section 3 includes a paper tray 31, a paper-feeding mechanism 32, and so forth. In the feed section 3, the paper-feeding mechanism 32 separates each of pieces of paper P placed in the paper tray 31 from the others and conveys the separated piece of paper P to the image-forming section 4.

The image-forming section 4 includes a scanner unit 41, a process cartridge 42, a fixing device 43, and so forth.

The scanner unit 41 has a known configuration basically including a laser emitter (not shown), a polygonal mirror, a lens, a reflector (reference numerals are omitted), and so forth. In the scanner unit 41, a laser beam travels along a path shown by the two-dot chain line in FIG. 1, and is applied to the surface of a photosensitive drum 51, included in the process cartridge 42, by rapid scanning.

Figure 2:
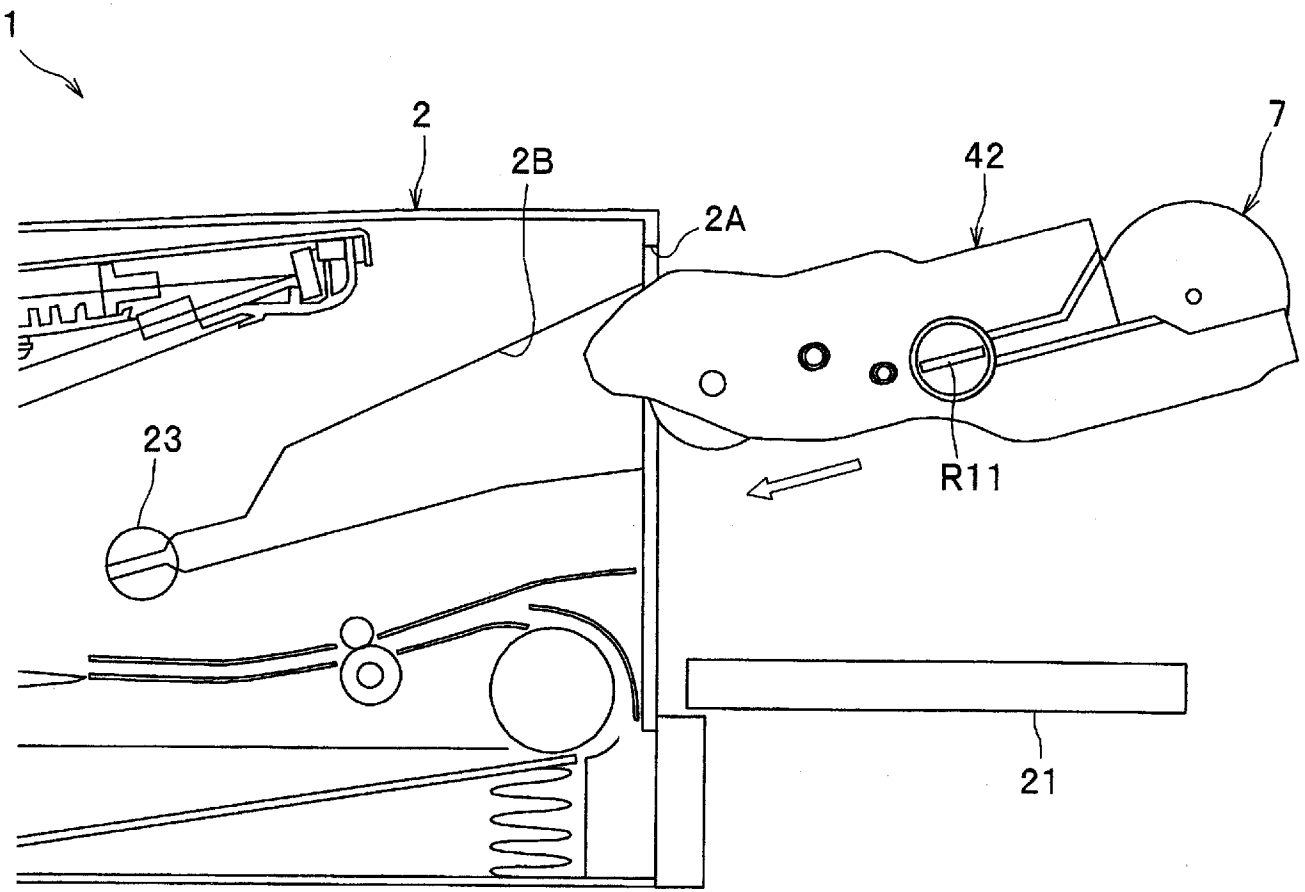
FIG. 2 is a cross-sectional view showing a state where a front cover is opened and the developing unit is being mounted.

The process cartridge 42 is mountable into and demountable from the apparatus body 2 by opening the front cover 21 according to need (see FIG. 2). The process cartridge 42 includes a drum cartridge 5, a developing device 6 mountable onto and demountable from the drum cartridge 5, and a developer cartridge 7 mountable onto and demountable from the developing device 6.

The drum cartridge 5 includes the photosensitive drum 51, a transfer roller 52, a scorotron charger 53, and so forth.

The developing device 6 basically includes a developing roller 61, a thickness-regulating blade 62, and a supplying roller 63. The developer cartridge 7 contains toner as an exemplary developer and is capable of conveying the toner into the developing device 6 provided adjacent thereto on the rear side thereof. The developing device 6 and the developer cartridge 7 will be described in detail separately below.

In the process cartridge 42 configured as above, the toner conveyed from the developer cartridge 7 into the developing device 6 is supplied onto the developing roller 61 by the supplying roller 63 that is rotating, and is positively charged by friction between the supplying roller 63 and the developing roller 61. The toner supplied onto the developing roller 61 is evened out by the thickness-regulating blade 62 that is in sliding contact with the developing roller 61 that is rotating, whereby a thin layer of toner having a uniform thickness is borne by the developing roller 61.

Meanwhile, in the drum cartridge 5, the surface of the photosensitive drum 51 is uniformly and positively charged by the scorotron charger 53, and is subsequently exposed with the laser beam from the scanner unit 41 by rapid scanning. Thus, the potentials of the exposed portions of the photosensitive drum 51 are reduced, whereby an electrostatic latent image based on image data is formed. Subsequently, with the rotation of the developing roller 61, the toner on the developing roller 61 is supplied onto the electrostatic latent image on the photosensitive drum 51 by coming into contact with the photosensitive drum 51.

Thus, the toner is selectively borne by the photosensitive drum 51, and the electrostatic latent image is visualized by reversal development, whereby a toner image is obtained. Subsequently, when a piece of paper P is conveyed through the nip between the photosensitive drum 51 and the transfer roller 52, the toner image on the photosensitive drum 51 is transferred onto the piece of paper P.

The fixing device 43 includes a heating roller 43A and a pressing roller 43B. In the fixing device 43, the toner transferred onto the piece of paper P is thermally fixed while the piece of paper P is conveyed through the nip between the heating roller 43A and the pressing roller 43B. The piece of paper P subjected to the thermal fixing performed by the fixing device 43 is discharged onto the discharge tray 22 by a discharging roller 44 provided on the downstream side with respect to the fixing device 43.

[Details of Developing Device and Developer Cartridge]

The configurations of the developing device 6 and the developer cartridge 7 will now be described in detail. In the embodiment, the developing device 6 and the developer cartridge 7 in combination form a developing unit DU.

As shown in FIG. 1, the developing device 6, including the developing roller 61, the thickness-regulating blade 62, and the supplying roller 63 as described above, further includes an auger 64 and a developing-device case 65 in which the foregoing components are provided.

The point of contact between the developing roller 61 and the thickness-regulating blade 62 resides at a higher position than the point of contact between the developing roller 61 and the supplying roller 63. Therefore, the accumulation of toner in the developing device 6 around the point of contact between the developing roller 61 and the thickness-regulating blade 62 is suppressed. Consequently, the leakage of toner from that point of contact (a situation where an excessive amount of toner passes through that point of contact) is suppressed.

Figure 3:
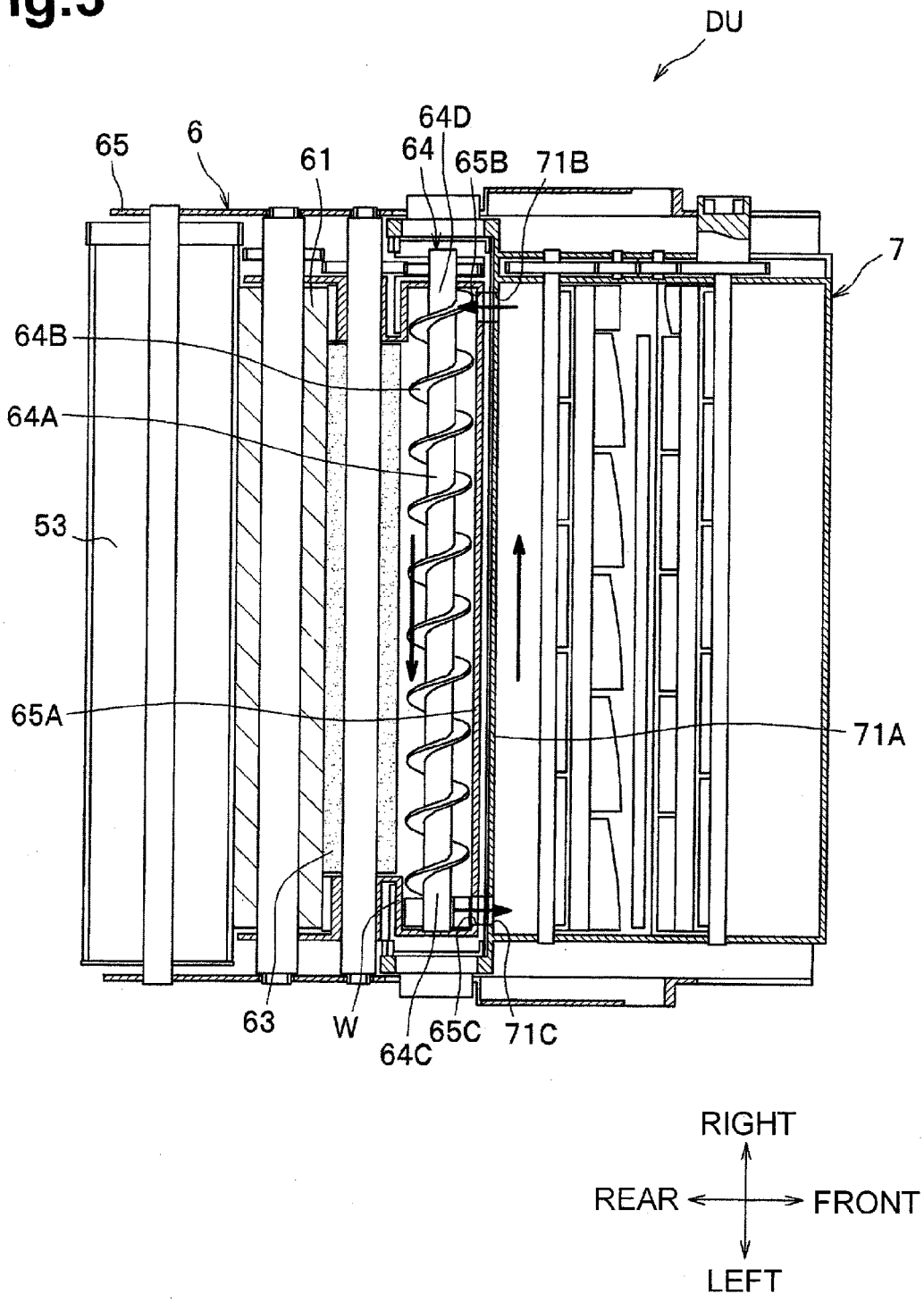
FIG. 3 is a cross-sectional view of the developing unit taken along the axial direction of an auger.

The auger 64 conveys toner in the axial direction of the supplying roller 63. Referring to FIG. 3, the auger 64 includes a rotating shaft 64A and a spiral blade 64B provided in spirals around the rotating shaft 64A. The auger 64 is provided on the front side (on a lateral side) with respect to the supplying roller 63. The rotating shaft 64A is rotatably supported by the developing-device case 65.

One end 64C of the auger 64 on the downstream side in the direction of conveyance by the auger 64 (specifically, the left end of a portion of the auger 64 having the spiral blade 64B) is extended axially outward with respect to the supplying roller 63 (specifically, a cylindrical portion of the supplying roller 63 that is to bear toner). A wall W is provided between the one end 64C extended axially outward as described above and the developing roller 61 (a portion of the developing roller 61 extended axially outward with respect to the supplying roller 63). The wall W suppresses the movement of toner from the side near the auger 64 toward the developing roller 61.

The toner conveyed in the axial direction by the auger 64 is moved to a space between the wall W provided on the axially outer side with respect to the supplying roller 63 and a partition wall 65A described below, i.e., a space isolated from the developing roller 61. Thus, the wall W reduces the pressure of the toner conveyed to the space between the wall W and the partition wall 65A from being applied to the developing roller 61.

Another end 64D of the auger 64 on the upstream side in the direction of conveyance by the auger 64 is extended axially outward with respect to the supplying roller 63.

The developing device 6 and the developer cartridge 7 have partition walls 65A and 71A, respectively, provided therebetween in such a manner as to separate the insides thereof. Referring to FIG. 1, the partition walls 65A and 71A are provided on a side across the auger 64 from the supplying roller 63 and around the auger 64 in such a manner as to extend above and below the auger 64. Thus, the auger 64 conveys toner in a good manner. The partition wall 71A of the developer cartridge 7 is an example of a first arc-shaped wall, and the partition wall 65A of the developing device 6 is an example of a second arc-shaped wall.

The partition walls 65A and 71A each have an arc shape in cross-sectional view that is concave from the side near the developing device 6 toward the developer cartridge 7, and a semicylindrical shape surrounding the auger 64 when seen in the axial direction of the auger 64. The "semicylindrical shape" refers to a shape of a cylinder having a portion thereof cut off, rather than a shape of an exactly half cylinder. With the partition walls 65A and 71A each having such a semicylindrical shape, the auger 64 conveys toner in a better manner.

The semicylindrical partition walls 65A and 71A are positioned such that the centers of curvature thereof overlap the auger 64 when seen in the axial direction of the auger 64, specifically, the centers of curvature thereof coincide with the center of rotation of the auger 64. Thus, the auger 64 conveys toner in a better manner.

Referring to FIG. 3, the two adjoining partition walls 65A and 71A have supply ports 65B and 71B, respectively, through which toner is supplied from the developer cartridge 7 to the developing device 6 and return ports 65C and 71C, respectively, through which toner is returned from the developing device 6 to the developer cartridge 7. The supply port 71B of the developer cartridge 7 is an example of a first opening, and the supply port 65B of the developing device 6 is an example of a second opening. Furthermore, the return port 71C of the developer cartridge 7 is an example of a third opening, and the return port 65C of the developing device 6 is an example of a fourth opening.

The return ports 65C and 71C face, from the front side, the one end 64C of the auger 64 extended axially outward with respect to the supplying roller 63. Thus, the toner conveyed by the auger 64 is returned to the developer cartridge 7 through the return ports 65C and 71C in a good manner, and the pressure of the toner that has reached the downstream side in the direction of conveyance is reduced from becoming too high.

The supply ports 65B and 71B are provided at positions deviated from the return ports 65C and 71C, respectively, in the axial and rotating directions of the auger 64 (see FIGS. 5A to 6B), specifically, positions facing the other end 64D of the auger 64 extended axially outward with respect to the supplying roller 63. The supply ports 65B and 71B, provided in the respective partition walls 65A and 71A having semicylindrical shapes in cross-sectional view, reside on the upstream side in the direction of rotation of a first agitator A1, described below (see FIG. 7), with respect to points NP on the partition walls 65A and 71A nearest to a rotating shaft A11 (the center of rotation) of the first agitator A1. Therefore, toner held by the first agitator A1 is pushed into the supply ports 65B and 71B. Thus, the efficiency of conveyance by the first agitator A1 is increased.

Referring to FIGS. 4 to 6B, the developer cartridge 7 and the developing device 6 are provided with a first shutter S1 and a second shutter S2, respectively. The first and second shutters S1 and S2 are movable along the peripheries of the partition walls 71A and 65A, thereby opening/closing the supply ports 71B and 65B and the return ports 71C and 65C.

Figure 5A:
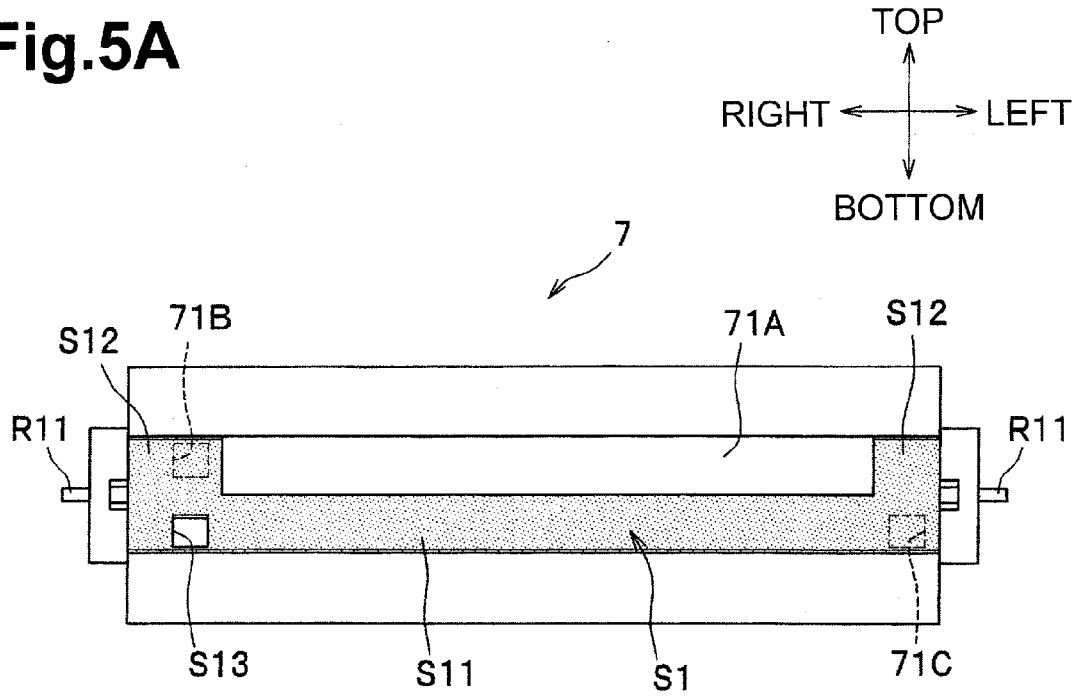
FIGS. 5A and 5B are rear views of the developer cartridge when a first shutter is at a closing position and at an opening position, respectively.
Figure 5B:
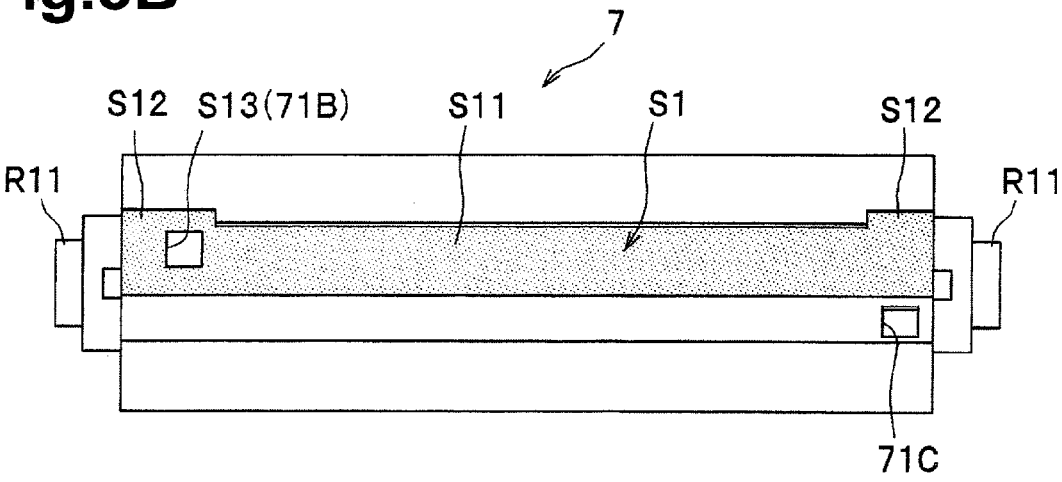

The first shutter S1 provided on the developer cartridge 7 has an arc shape in cross-sectional view and, as shown in FIG. 5A, includes a base portion S11 and extended portions S12. The base portion S11 extends from one of the right and left ends of the partition wall 71A to the other. The extended portions S12 are extended upward from the right and left ends, respectively, of the base portion S11. The base portion S11 has at the right end thereof an opening S13 that is of the same size as the supply port 71B.

When the first shutter S1 is rotated upward from a position at which the right extended portion S12 thereof closes the supply port 71B and the left end of the base portion S11 thereof closes the return port 71C, referring now to FIG. 5B, the supply port 71B is opened through the opening S13 and the return port 71C is opened because the base portion S11 is moved to the upper side with respect to the return port 71C. The position where the first shutter S1 opens the supply port 71B is an example of a first position, and the first shutter S1 closes the supply port 71B is an example of a second position.

Figure 4:
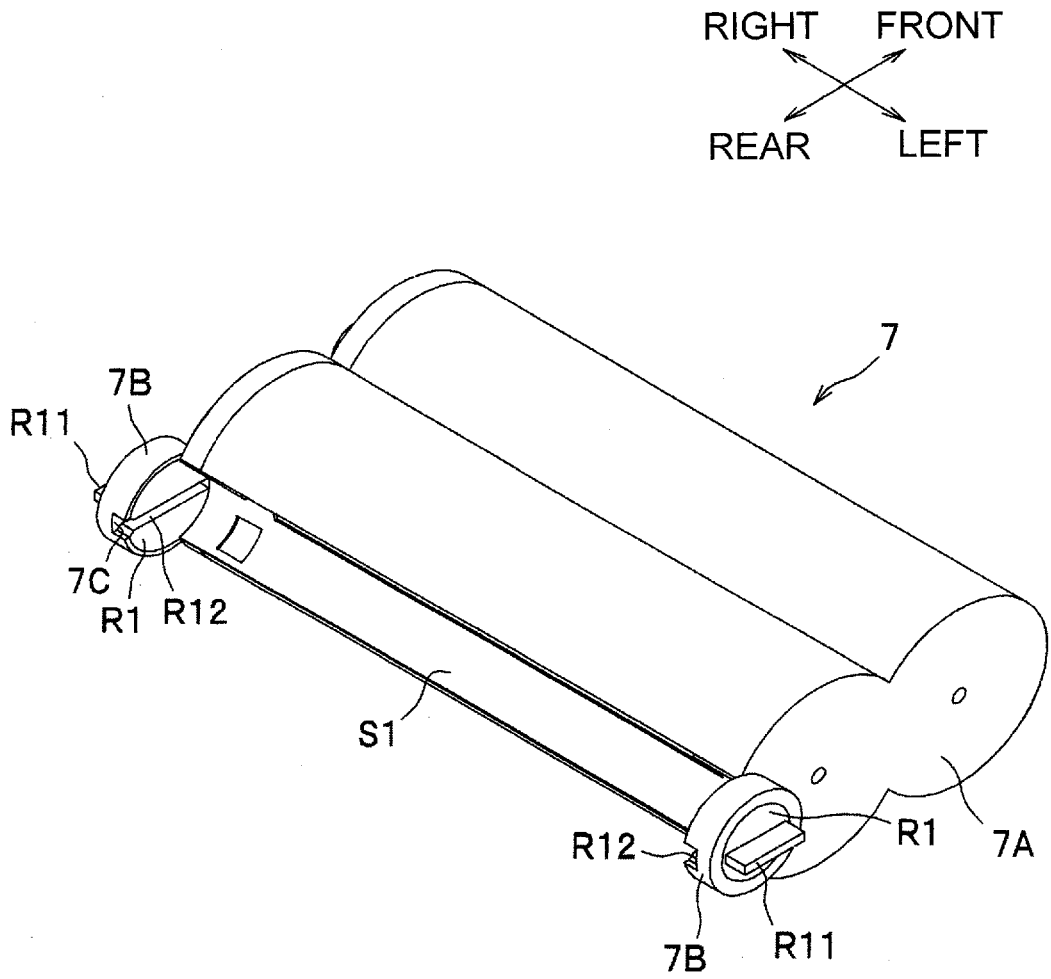
FIG. 4 is a perspective view of a developer cartridge.

Referring to FIG. 4, the first shutter Si is provided at the axial ends thereof with first rotatable members R1, respectively, integrally secured thereto in such a manner as to be rotatable together with the first shutter S1. The first rotatable members R1 are each a disc-like member whose center coincides with the center of curvature of the first shutter S1 having an arc shape in cross-sectional view. The first rotatable members R1 are rotatably held at the entire peripheries thereof by ring-shaped holding members 7B, respectively, provided on a toner case 7A described separately below.

The first rotatable members R1 have outer engaging portions R11 (an example of an operation portion) on the laterally outer faces thereof. A driving force for opening/closing the first and second shutters S1 and S2 is transmitted to the outer engaging portions R11. The outer engaging portions R11 project laterally outward. When the first shutter S1 is at the closing position, the outer engaging portions R11 form long ribs extending in a direction in which the developer cartridge 7 is mounted into the apparatus body 2 in which the developing device 6 is mounted or in which the process cartridge 42 is mounted into the apparatus body 2 (see FIG. 2).

Therefore, as shown in FIG. 2, when the process cartridge 42 is mounted into the apparatus body 2, the outer engaging portions R11 engage with couplings 23 (members that transmit the driving force) provided on the apparatus body 2. In a case where only the developer cartridge 7 is to be replaced in a state where the drum cartridge 5 and the developing device 6 remain mounted in the apparatus body 2, the outer engaging portions R11 engage with the couplings 23 of the apparatus body 2 when the developer cartridge 7 is mounted onto the developing device 6.

The couplings 23 have long grooves, respectively, extending in the direction in which the developer cartridge 7 or the process cartridge 42 is mounted. The outer engaging portions R11 engage with the long grooves by sliding thereinto. The apparatus body 2 has guiding grooves 2B gradually narrowed toward the couplings 23 so as to guide the outer engaging portions R11 of the first rotatable members R1.

Referring to FIG. 4, the first rotatable members R1 further have inner engaging portions R12 (an example of a first engaging portion), respectively, on the laterally inner faces thereof (the inner faces facing second rotatable members R2 described below and shown in FIG. 9). That is, the first rotatable members R1 are positioned on an outer side of the second rotatable members R2. The inner engaging portions R12 engage with developing-device-side engaging portions R21 provided on the second rotatable members R2, whereby the first rotatable members R1 and the second rotatable members R2 are allowed to rotate together. The developing-device-side engaging portions R21 are exemplary developing-section-side engaging portions. When the first shutter S1 is at the closing position, the inner engaging portions R12 form guiding grooves extending in the direction in which the developer cartridge 7 is mounted onto the developing device 6. Therefore, when the developer cartridge 7 is mounted onto the developing device 6, the inner engaging portions R12 engage with the developing-device-side engaging portions R21 of the second rotatable members R2. The holding members 7B have on the rear side thereof notches 7C, respectively, corresponding to the inner engaging portions R12 forming the guiding grooves.

Figure 6A:
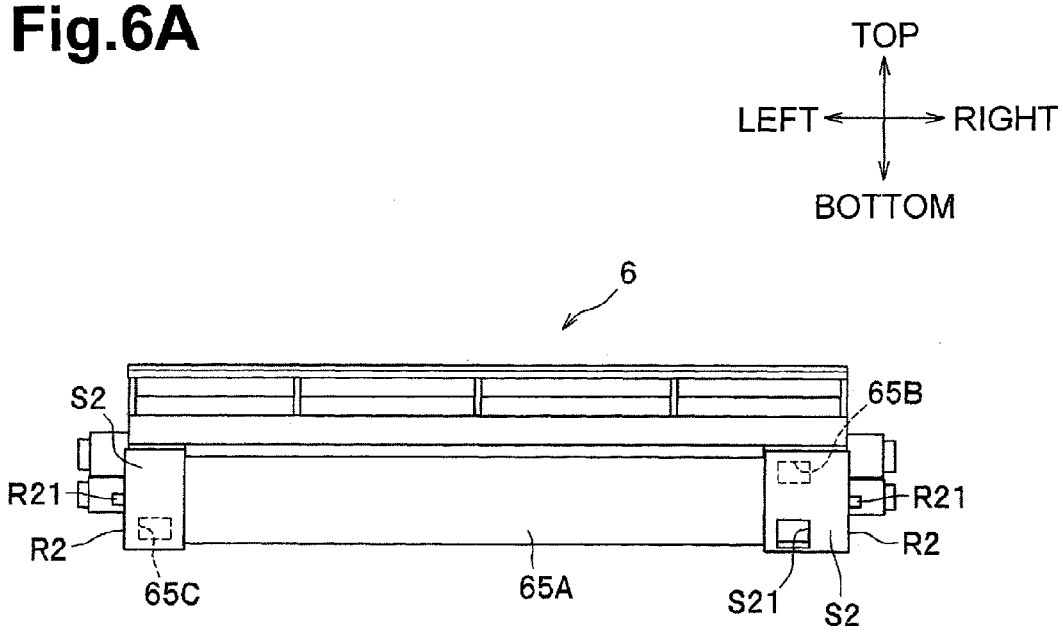
FIGS. 6A and 6B are front views of a developing device when a second shutter is at a closing position and at an opening position, respectively.
Figure 6B:
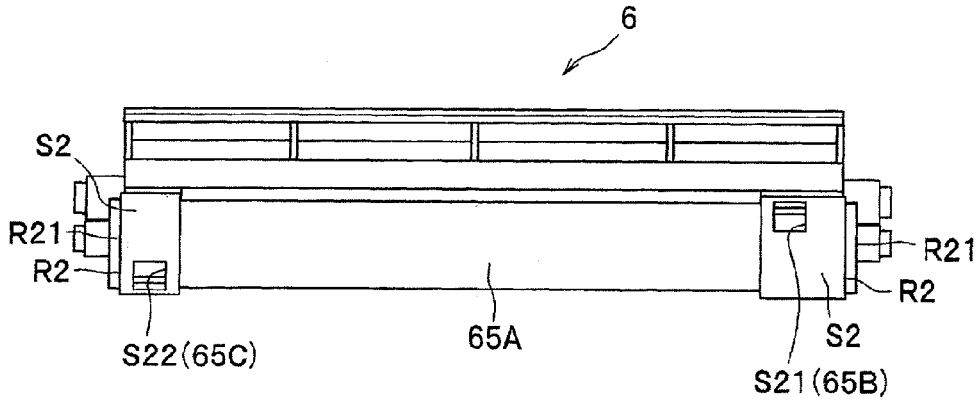

Referring to FIG. 6A, the second shutter S2 provided on the developing device 6 includes two second shutters S2 having arc shapes in cross-sectional view. The second shutters S2 are provided at right and left ends, respectively, of the partition wall 65A. The second shutters S2 have openings S21 and S22 (see FIG. 6B), respectively. The opening S21 corresponds to the supply port 65B. The opening S22 corresponds to the return port 65C. Therefore, when the openings S21 and S22 are deviated from the supply port 65B and the return port 65C as shown in FIG. 6A, the supply port 65B and the return port 65C are closed. When the openings S21 and S22 coincide with the supply port 65B and the return port 65C as shown in FIG. 6B, the supply port 65B and the return port 65C are opened. The position where the second shutter S2 opens the supply port 65B is an example of a third position, and the second shutter S2 closes the supply port 65B is an example of a fourth position.

The second shutters S2 have on the axially outer ends thereof the second rotatable members R2 (see FIG. 8A), respectively, having disc-like shapes. The second rotatable members R2 are integrally secured to the second shutters S2 in such a manner as to be rotatable together with the second shutters S2. The second rotatable members R2 have the developing-device-side engaging portions R21 (an example of a second engaging portion), respectively, projecting laterally outward. When the second shutters S2 are at the closing position, the developing-device-side engaging portions R21 extend in the direction in which the developer cartridge 7 is mounted onto the developing device 6 (see FIG. 8B).

Figure 8A:
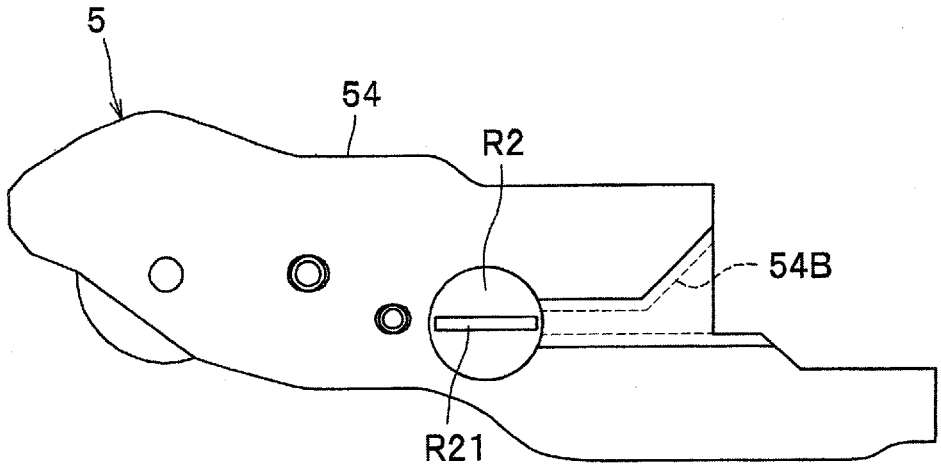
FIGS. 8A and 8B are side views of a drum cartridge without and with, respectively, the developer cartridge.
Figure 8B:
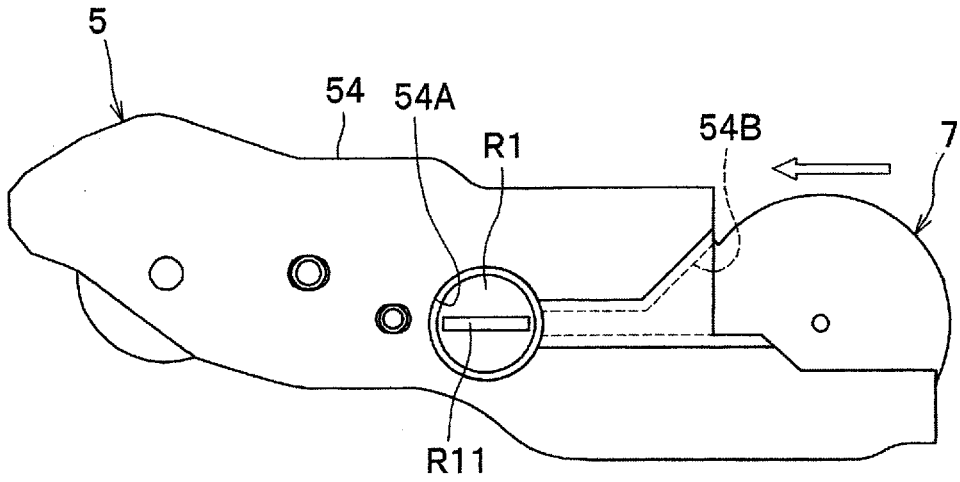
Figure 9:
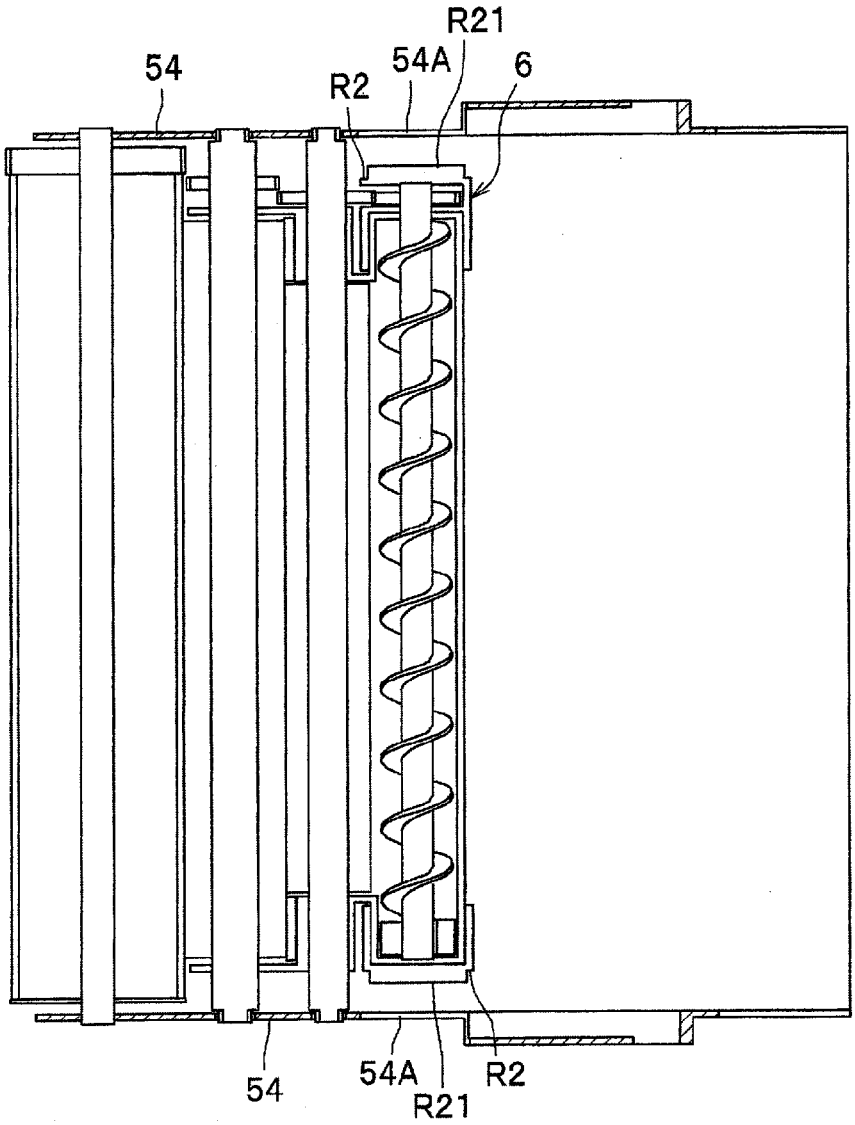
FIG. 9 is a cross-sectional view of the drum cartridge without the developer cartridge.
Figure 9:
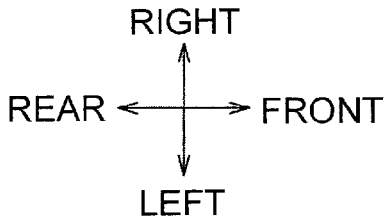
Figure 10A:
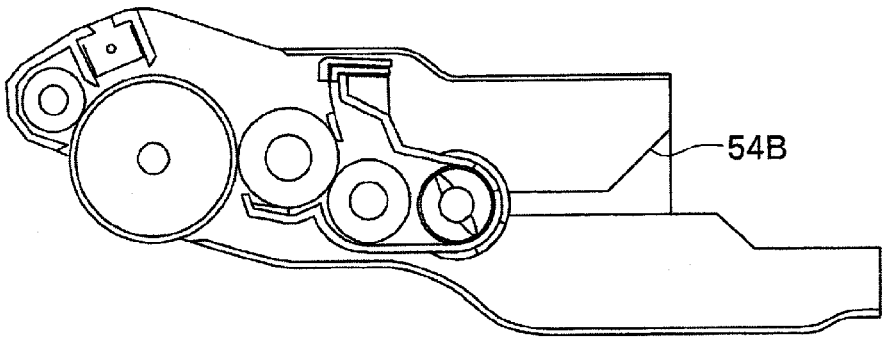
FIGS. 10A and 10B are a cross-sectional view of the drum cartridge without the developer cartridge and another cross-sectional view showing a state where the developer cartridge is being mounted onto the drum cartridge, respectively.
Figure 10B:
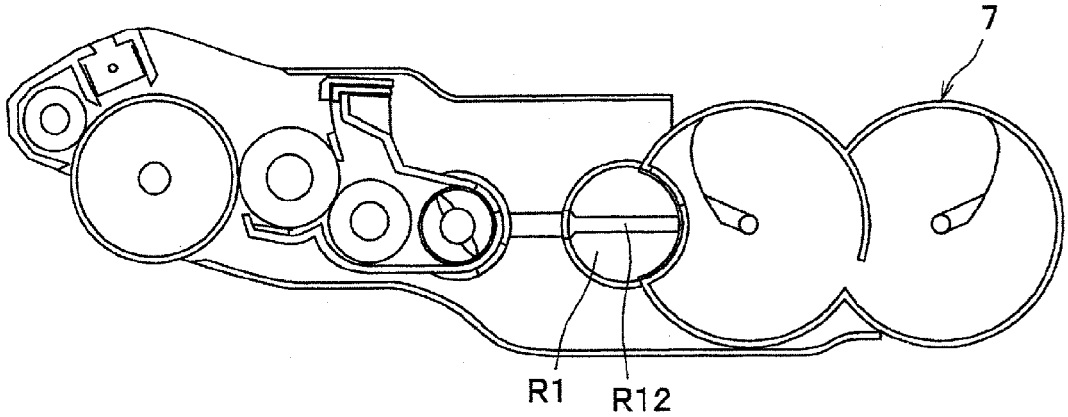

Specifically, referring to FIG. 9, the developing-device-side engaging portions R21 are provided on the inner side with respect to right and left walls 54 of the drum cartridge 5, and are exposed to the outside on the lateral sides through openings 54A provided in the walls 54 (see FIG. 8A). When the developer cartridge 7 is mounted onto the developing device 6 configured as above, the first rotatable members R1 of the developer cartridge 7 pass through the spaces between the second rotatable members R2 and the walls 54 and engage with the developing-device-side engaging portions R21, thereby being exposed to the outside through the openings 54A as shown in FIG. 8B.

Referring to FIGS. 8A, 8B, 10A, and 10B, the walls 54 of the drum cartridge 5 have guiding grooves 54B, respectively, gradually narrowed toward the developing device 6 so as to guide the outer engaging portions R11 of the first rotatable members R1.

Figure 7A:
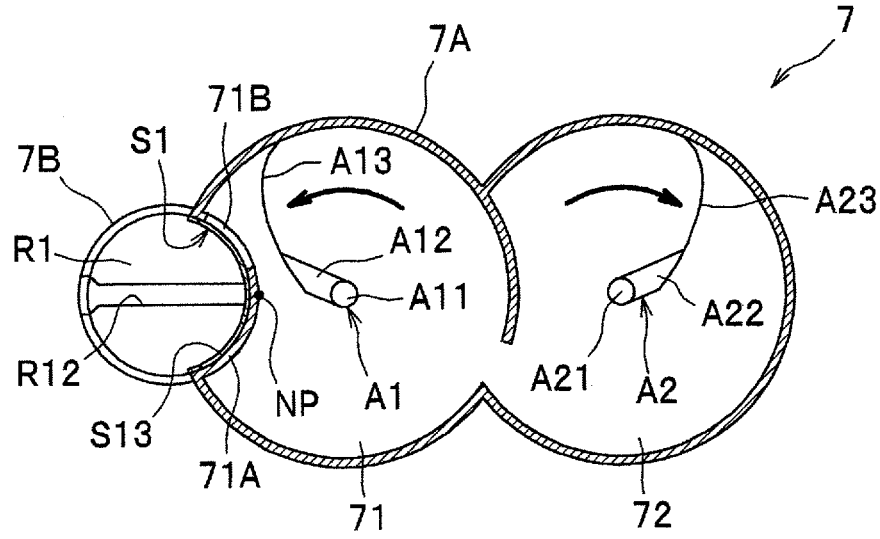
FIGS. 7A and 7B are cross-sectional views of the developer cartridge when the first shutter is at the closing position and at the opening position, respectively.
Figure 7B:
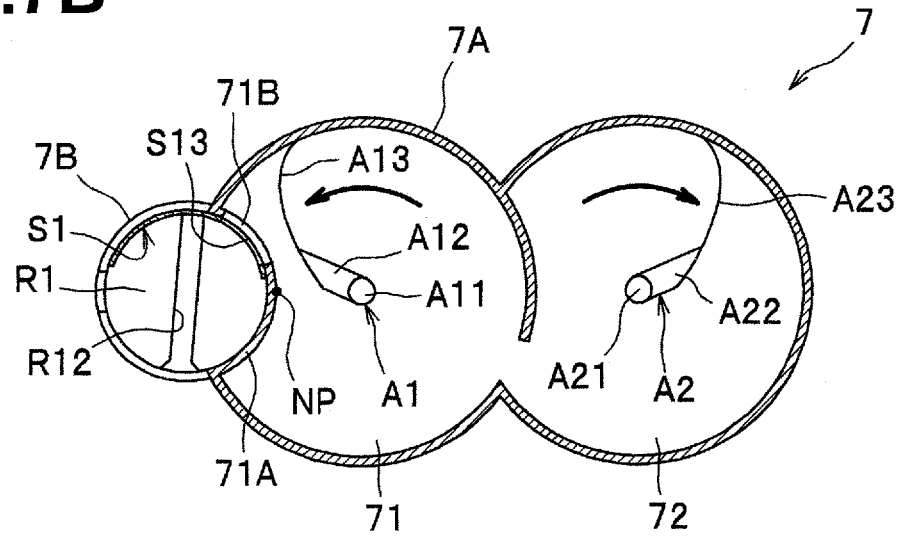

Referring to FIGS. 7A and 7B, the developer cartridge 7 includes the toner case 7A as an exemplary developer container, and first and second agitators A1 and A2 as exemplary agitating members.

The toner case 7A includes two substantially hollow cylindrical chambers, specifically, first and second chambers 71 and 72, in which toner is contained. The first agitator A1 is rotatably provided in the first chamber 71. The second agitator A2 is rotatably provided in the second chamber 72.

The first agitator A1 includes the rotating shaft A11 rotatably supported by the right and left walls of the developer cartridge 7 (the first chamber 71), a support A12 extending outward in the radial direction from the rotating shaft A11, and an agitating blade A13 supported by the support A12. The first agitator A1 rotates (counterclockwise in FIGS. 7A and 7B) in such a manner as to sweep the partition wall 71A from the top to the bottom. That is, the agitating blade A13 moves toward the supply port 71B provided on the upstream side in the direction of rotation thereof with respect to the point NP, and away from a portion on the downstream side in the direction of rotation thereof with respect to the point NP (a portion where the return port 71C is provided, see FIGS. 5A and 5B). Therefore, the agitating blade A13 efficiently conveys toner to the supply port 71B but does not push back the toner returned from the return port 71C.

The second agitator A2 includes a rotating shaft A21, a support A22, and an agitating blade A23, as the first agitator A1 does. The second agitator A2 rotates in the opposite direction (clockwise in FIGS. 7A and 7B) to the direction of rotation of the first agitator A1. Therefore, toner accumulated at the bottom of the second chamber 72 is efficiently conveyed to the first chamber 71.

The embodiment described above provides the following benefits.

The partition wall 71A of the developer cartridge 7 is concave inward, and the inwardly concave partition wall 71A receives the pressure produced in conveying toner. Therefore, toner is efficiently conveyed to the developing device 6 through the supply port 71B provided in the partition wall 71A. Thus, the efficiency of conveyance is increased. In addition, the first rotatable members R1 are provided at both axial ends of the first shutter S1. Therefore, by transmitting a driving force (including a manual driving force) to the outer engaging portions R11 of the first rotatable members R1 at both ends of the first shutter S1, the first shutter S1 is smoothly opened/closed without being twisted.

The supply ports 65B and 71B are provided on the upstream side in the direction of rotation of the first agitator A1 with respect to the points NP on the partition walls 65A and 71A having arc shapes in cross-sectional view, the points NP being nearest to the rotating shaft A11 of the first agitator A1. Therefore, toner held by the first agitator A1 is pushed into the supply ports 65B and 71B, and the efficiency of conveyance by the first agitator A1 is increased.

The first rotatable members R1 have disc-like shapes whose centers coincide with the center of curvature of the first shutter S1. Therefore, the occurrences of interferences between the first rotatable members R1 and the peripheral members are suppressed.

The first rotatable members R1 are rotatably held at the entire peripheries thereof by the ring-shaped holding members 7B. Therefore, the first rotatable members R1 are held stably.

The first rotatable members R1 provided at both axial ends of the first shutter S1 have the inner engaging portions R12 configured to engage with the developing-device-side engaging portions R21 of the second rotatable members R2. Therefore, the first and second shutters S1 and S2 are simultaneously moved to the opening/closing position.

The first rotatable members R1 have on the laterally outer faces thereof the outer engaging portions R11 to which the driving force for opening/closing the first and second shutters S1 and S2 is transmitted. Therefore, compared to a configuration in which the first rotatable members R1 have engaging portions on the peripheries thereof, the first rotatable members R1 are assuredly made to engage with the couplings 23 provided on the apparatus body 2.

The inner engaging portions R12 are provided in such a manner as to extend in the direction in which the developer cartridge 7 is mounted onto the developing device 6. Therefore, the inner engaging portions R12 are made to engage with the developing-device-side engaging portions R21 of the second rotatable members R2 by mounting the developer cartridge 7 onto the developing device 6. Thus, the efficiency of work is increased.

The outer engaging portions R11 are provided in such a manner as to extend in the direction in which the developer cartridge 7 is mounted onto the developing device 6. Therefore, the outer engaging portions R11 are made to engage with the couplings 23 of the apparatus body 2 by mounting the developer cartridge 7 onto the developing device 6 that is in the apparatus body 2. Thus, the efficiency of work is increased.

After the toner conveyed by the auger 64 is conveyed to the front side (the side remote from the developing roller 61) of the wall W provided on the outside in the axial direction with respect to the supplying roller 63, the toner is discharged into the developer cartridge 7 through the return ports 65C and 71C. Therefore, the wall W reduces the pressure of the toner that has reached the downstream side in the direction of conveyance by the auger 64 from being applied to the developing roller 61. Consequently, the occurrence of toner leakage around the developing roller 61 is suppressed.

The partition walls 65A and 71A are provided around the auger 64 in such a manner as to extend above and below the auger 64. Therefore, the auger 64 conveys toner in a good manner.

The supply ports 65B and 71B are deviated from the return ports 65C and 71C in the axial direction of the auger 64. Therefore, toner is made to circulate in a good manner with a single auger 64.

The point of contact between the developing roller 61 and the thickness-regulating blade 62 resides at a higher position than the point of contact between the developing roller 61 and the supplying roller 63. Therefore, the occurrence of toner leakage from the point of contact between the developing roller 61 and the thickness-regulating blade 62 is suppressed.

The partition walls 65A and 71A each have a semicylindrical shape extending around the auger 64 when seen in the axial direction of the auger 64. That is, the partition walls 65A and 71 A have no corners at which toner may remain accumulated. Therefore, the auger 64 conveys toner in a good manner.

The centers of curvature of the partition walls 65A and 71A overlap the auger 64 when seen in the axial direction of the auger 64. Specifically, the centers of curvature of the partition walls 65A and 71A coincide with the center of rotation of the auger 64. Therefore, the auger 64 conveys toner in a better manner.

The present invention is not limited to the above embodiment and may be embodied in various ways as exemplified below.

In the embodiment, two second shutters S2 are provided on the developing device 6. The present invention is not limited to such an embodiment. For example, a single shutter may alternatively be provided on the developing device. The positions and numbers of supply ports and return ports are not limited to those specified in the embodiment, and may be specified according to need.

In the embodiment, the partition walls 65A and 71A of the developing device 6 and the developer cartridge 7 have the supply ports 65B and 71B and the return ports 65C and 71C. The present invention is not limited to such an embodiment. A single large opening may alternatively be provided in one of the two partition walls in such a manner as to communicate with both of the supply port and the return port provided in the other partition wall. That is, for example, the entirety of the partition wall 65A of the developing device 6 according to the embodiment may be provided as an opening, and the opening of the developing device 6 may be covered with the partition wall 71A of the developer cartridge 7. In other words, the partition wall of the developer cartridge 7 may form part (the partition wall) of the developing device 6.

Figure 11:
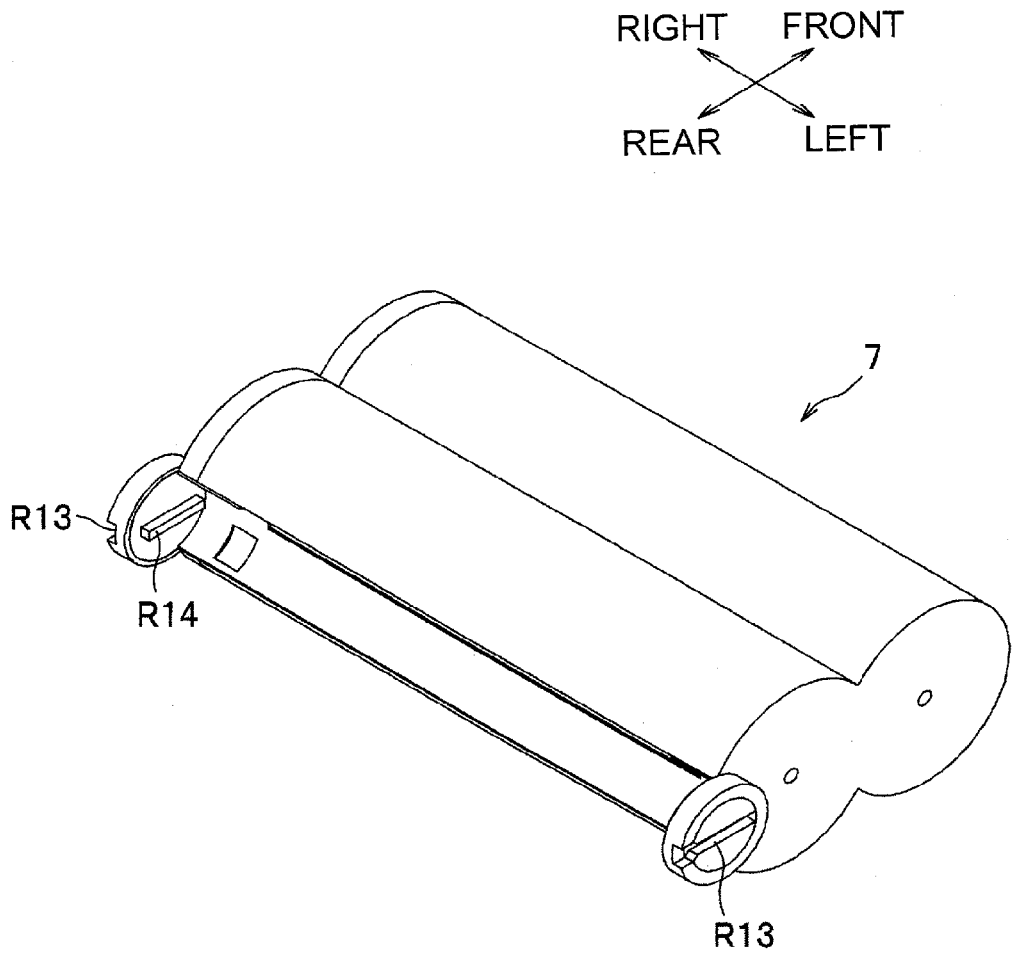
FIG. 11 is a perspective view of a developer cartridge according to a variation.

The concave and convex shapes of the engaging portions (the developing-device-side engaging portions R21, the inner engaging portions R12 (an example of a first engaging portion), the outer engaging portions R11, the couplings 23, and so forth) according to the embodiment may be reversed according to need. For example, as shown in FIG. 11, outer engaging portions R13 (an example of an operation portion) may form guiding grooves, and inner engaging portions R14 (an example of a first engaging portion) may form projections.

The embodiment employs, as an agitating member, the agitator A1 including the rotating shaft A11, the support A12, and the agitating blade A13. The present invention is not limited to such an embodiment. For example, an agitator not including the support A12 may alternatively be employed. In addition, unlike the thickness-regulating blade 62 according to the embodiment, the regulating member may not necessarily include a metal plate and a rubber member provided at the tip of the metal plate. For example, the regulating member may alternatively be a blade including a metal plate not having a rubber member.

The embodiment of the present invention concerns the laser printer 1. The present invention is not limited to be applied to the laser printer 1, and may be applied to any other image-forming apparatuses such as a copier, a multifunctional machine, and the like.

The embodiment employs, as an engaging portion, the outer engaging portions R11 provided on the laterally outer faces of the first rotatable members R1. The present invention is not limited to such an embodiment. For example, an engaging portion provided on a peripheral surface of the first rotatable members R1 may alternatively be employed.

The embodiment employs a configuration in which the inner engaging portions R12 provided on the laterally inner face of the first rotatable member R1 engages with the developing-device-side engaging portions R21 provided on the laterally outer face of the second rotatable member R2. The present invention is not limited to such an embodiment. For example, a configuration in which the outer engaging portions R11 provided on the laterally outer face of the first rotatable member R1 engages with engaging portions provided on the laterally inner face of the second rotatable member R2 may alternatively be employed.

What is claimed is:

1. A developer cartridge removably mounted to a developing device, comprising:

a developer container configured to contain developer, the developer container including a first arc-shaped wall having an arc shape that is concave inward in a cross-sectional view, wherein a first opening is formed in the first arc-shaped wall;

an agitating member positioned in the developer container and configured to agitate the developer;

a first shutter having an arc shape in the cross-sectional view and configured to rotate along a periphery of the first arc-shaped wall between a first position to open the first opening and a second position to close the first opening; and a first rotatable member positioned at at least one axial end of the first shutter, wherein the first shutter is configured to rotate in response to rotating of the first rotatable member.

2. The developer cartridge according to claim 1, wherein the agitating member rotates to convey the developer in the developer container to the developing device through the first opening.

3. The developer cartridge according to claim 1, wherein the first rotatable member is positioned at each of both ends of the first shutter.

4. The developer cartridge according to claim 1, wherein the first opening is positioned on an upstream side in a direction of rotation of the agitating member with respect to a point on the first arc-shaped wall nearest to a rotating shaft of the agitating member.

5. The developer cartridge according to claim 1, wherein the first rotatable member has a disc-like shape whose center coincides with a center of curvature of the first shutter.

6. The developer cartridge according to claim 5, wherein the developer container comprises a holding member that rotatably holds the first rotatable member.

7. The developer cartridge according to claim 6, wherein the holding member has a ring shape that holds an entire periphery of the first rotatable member.

8. A developing unit comprising a developer cartridge and a developing device, the developer cartridge comprising:

a developer container configured to contain developer, the developer container including a first arc-shaped wall having an arc shape that is concave inward in a cross-sectional view, wherein a first opening is formed in the first arc-shaped wall;

an agitating member positioned in the developer container and configured to agitate the developer;

a first shutter having an arc shape in the cross-sectional view and configured to rotate along a periphery of the first arc-shaped wall between a first position to open the first opening and a second position to close the first opening; and a first rotatable member positioned at at least one axial end of the first shutter, wherein the first shutter is configured to rotate in response to rotating of the first rotatable member; and the developing device comprising:

a second arc-shaped wall having an arc shape extending along the first arc-shaped wall, wherein a second opening corresponding to the first opening is formed;

a second shutter having an arc shape in the cross-sectional view and configured to rotate along a periphery of the second arc-shaped wall between a third position to open the second opening and a fourth position to close the second opening; and a second rotatable member positioned at at least one axial end of the second shutter, wherein the second shutter is configured to rotate in response to rotating of the second rotatable member, wherein the first rotatable member comprises a first engaging portion, and the second rotatable member comprises a second engaging portion, wherein the first engaging portion engages with the second engaging portion, and the first rotatable member and the second rotatable member rotate together, wherein when the first shutter is in the first position and the second shutter is in the third position, the developer in the developer container is conveyed to the developing device through the first opening and the second opening.

9. The developing unit according to claim 8, wherein the first rotatable member is positioned on an outer side of the second rotatable member.

10. The developing unit according to claim 9, wherein the first engaging portion comprises an operation portion, and when the operation portion is operated to rotate the first rotatable member, the second rotatable member rotates together and the first shutter and the second shutter rotate.

11. The developing unit according to claim 8, wherein the first arc-shaped wall further comprises a third opening, the second arc-shaped wall further comprises a fourth opening corresponding to the third opening, and wherein when the first shutter is in the first position and the second shutter is in the third position, the developer in the developing device is returned to the developer container through the third opening and the fourth opening.

12. The developing unit according to claim 8, wherein the first engaging portion has a groove or a projection extending in a direction perpendicular to a rotating shaft of the first rotatable member.

13. The developing unit according to claim 10, wherein the operation portion has a groove or a projection extending in a direction perpendicular to a rotating shaft of the first rotatable member.

14. The developing unit according to claim 8, wherein when the first shutter is in the second position and the second shutter is in the fourth position, a direction in which the first engaging portion extends and a direction in which the second engaging portion extends are the same as a direction in which the developer cartridge engages with the developing device, and the first engaging portion is engageable with the second engaging portion.

15. A developing unit comprising a developer cartridge and a developing device, the developer cartridge comprising:

a developer container configured to contain developer, the developer container including a first arc-shaped wall having an arc shape in a cross-sectional view, wherein a first opening is formed in the first arc-shaped wall;

an agitating member positioned in the developer container and configured to agitate the developer;

a first shutter having an arc shape in the cross-sectional view and configured to rotate along a periphery of the first arc-shaped wall between a first position to open the first opening and a second position to close the first opening; and a first rotatable member positioned at at least one axial end of the first shutter, wherein the first shutter is configured to rotate in response to rotating of the first rotatable member; and the developing device comprising:

a second arc-shaped wall having an arc shape extending along the first arc-shaped wall, wherein a second opening corresponding to the first opening is formed;

a second shutter having an arc shape in the cross-sectional view and configured to rotate along a periphery of the second arc-shaped wall between a third position to open the second opening and a fourth position to close the second opening; and a second rotatable member positioned at at least one axial end of the second shutter, wherein the second shutter is configured to rotate in response to rotating of the second rotatable member, wherein the first rotatable member comprises a first engaging portion, and the second rotatable member comprises a second engaging portion, wherein the first engaging portion engages with the second engaging portion, and the first rotatable member and the second rotatable member rotate together, wherein when the first shutter is in the first position and the second shutter is in the third position, the developer in the developer container is conveyed to the developing device through the first opening and the second opening.

* * * * *